US012245664B2

(12) United States Patent
Lee

(10) Patent No.: US 12,245,664 B2
(45) Date of Patent: Mar. 11, 2025

(54) ARTICLE OF FOOTWEAR HAVING AN UPPER

(71) Applicant: Nike, Inc., Beaverton, OR (US)

(72) Inventor: Yen Lin Lee, Taichung (TW)

(73) Assignee: NIKE, Inc., Beaverton, OR (US)

( * ) Notice: Subject to any disclaimer, the term of this patent is extended or adjusted under 35 U.S.C. 154(b) by 108 days.

(21) Appl. No.: 18/183,820

(22) Filed: Mar. 14, 2023

(65) Prior Publication Data

US 2023/0292886 A1 Sep. 21, 2023

Related U.S. Application Data

(60) Provisional application No. 63/319,907, filed on Mar. 15, 2022.

(51) Int. Cl.

| | |
|---|---|
| ***A43C 11/00*** | (2006.01) |
| ***A43B 23/02*** | (2006.01) |
| ***A43C 11/20*** | (2006.01) |

(52) U.S. Cl.

CPC ..... *A43C 11/20* (2013.01); *A43B 23/0235* (2013.01); *A43B 23/027* (2013.01); *A43C 11/00* (2013.01)

(58) Field of Classification Search

CPC ..... A43B 23/0235; A43B 23/0265; A43B 23/029; A43B 23/045; A43B 23/0205; A43B 23/0225; A43B 23/024; A43B 23/026; A43C 11/002

USPC ..... 36/45

See application file for complete search history.

(56) References Cited

U.S. PATENT DOCUMENTS

| | | | | |
|---|---|---|---|---|
| 2,533,976 | A * | 12/1950 | Teague | D06N 3/0013 428/522 |
| 5,343,638 | A * | 9/1994 | Legassie | A43B 23/0255 36/71 |
| 6,237,251 | B1 * | 5/2001 | Litchfield | A43B 13/203 36/31 |
| 6,482,492 | B1 * | 11/2002 | Hung | A43B 23/0205 36/3 R |
| 7,478,488 | B1 * | 1/2009 | Davis | A43B 23/029 36/3 A |
| 8,015,617 | B1 * | 9/2011 | Carbajal | B32B 27/281 2/2.5 |
| 8,309,478 | B2 * | 11/2012 | Nair | B32B 5/026 442/364 |
| 9,907,363 | B2 | 3/2018 | Smith et al. | |
| 11,280,590 | B1 * | 3/2022 | Eleazer | A43B 23/16 |

(Continued)

FOREIGN PATENT DOCUMENTS

| | | |
|---|---|---|
| DE | 202016008321 U1 | 7/2017 |
| WO | 2013019934 A1 | 2/2013 |
| WO | 2019046390 A1 | 3/2019 |

OTHER PUBLICATIONS

International Search Report in PCT/US2023/064312, mail date Jun. 9, 2023 (3 pages).

*Primary Examiner* — Marie D Bays

(74) *Attorney, Agent, or Firm* — Bookoff McAndrews, PLLC.

(57) ABSTRACT

An article of footwear, the article including a sole structure and an upper coupled to a top of the sole structure. The upper including an opening and a closure system, wherein the closure system includes at least one first sheet and a plurality of second sheets. The at least one first sheet and the plurality of second sheets being interleaved.

19 Claims, 11 Drawing Sheets

(56) References Cited

U.S. PATENT DOCUMENTS

| | | | | |
|---|---|---|---|---|
| 2002/0088145 | A1 | 7/2002 | Clark et al. | |
| 2004/0261295 | A1* | 12/2004 | Meschter | B44B 3/009 36/55 |
| 2005/0028404 | A1* | 2/2005 | Marvin | A43B 19/00 36/55 |
| 2005/0282454 | A1* | 12/2005 | Meschter | A41D 1/06 36/83 |
| 2012/0167413 | A1* | 7/2012 | Marvin | A43B 13/206 36/83 |
| 2013/0232815 | A1* | 9/2013 | Meythaler | A43B 5/025 428/140 |
| 2013/0303041 | A1* | 11/2013 | Kim | B32B 25/16 442/373 |
| 2015/0052778 | A1* | 2/2015 | Kirk | A43B 1/0009 442/204 |
| 2016/0227881 | A1* | 8/2016 | Beers | A43B 23/027 |
| 2017/0360155 | A1* | 12/2017 | Leary | A43B 23/081 |
| 2018/0049509 | A1 | 2/2018 | Zwick et al. | |
| 2019/0110557 | A1* | 4/2019 | Hobson | D03D 19/00 |
| 2020/0068995 | A1 | 3/2020 | Juckelandt et al. | |
| 2020/0275731 | A1 | 9/2020 | Bell et al. | |
| 2021/0120915 | A1* | 4/2021 | Panian | A43B 23/029 |
| 2021/0195998 | A1* | 7/2021 | Notrica | A43B 23/027 |
| 2021/0244128 | A1* | 8/2021 | Costa | A43B 3/0036 |
| 2021/0368941 | A1* | 12/2021 | Chen | A43B 1/0072 |
| 2022/0104582 | A1* | 4/2022 | Christensen | A43B 7/083 |
| 2023/0141325 | A1* | 5/2023 | Case | A43B 23/028 36/45 |
| 2023/0147306 | A1* | 5/2023 | Case | A43B 23/025 36/45 |
| 2024/0081481 | A1* | 3/2024 | Suzuki | A43B 23/024 |

* cited by examiner

ARTICLE OF FOOTWEAR HAVING AN UPPER

CROSS-REFERENCE TO RELATED APPLICATION(S)

This application claims priority to U.S. Provisional Application No. 63/319,907, filed Mar. 15, 2022, the entirety of which is incorporated herein by reference.

TECHNICAL FIELD

The present teachings generally relate to an article of footwear having an upper.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot.

BRIEF DESCRIPTION OF THE DRAWINGS

Corresponding reference numerals indicate corresponding parts throughout the several views of the drawings.

DESCRIPTION

Figure 1:
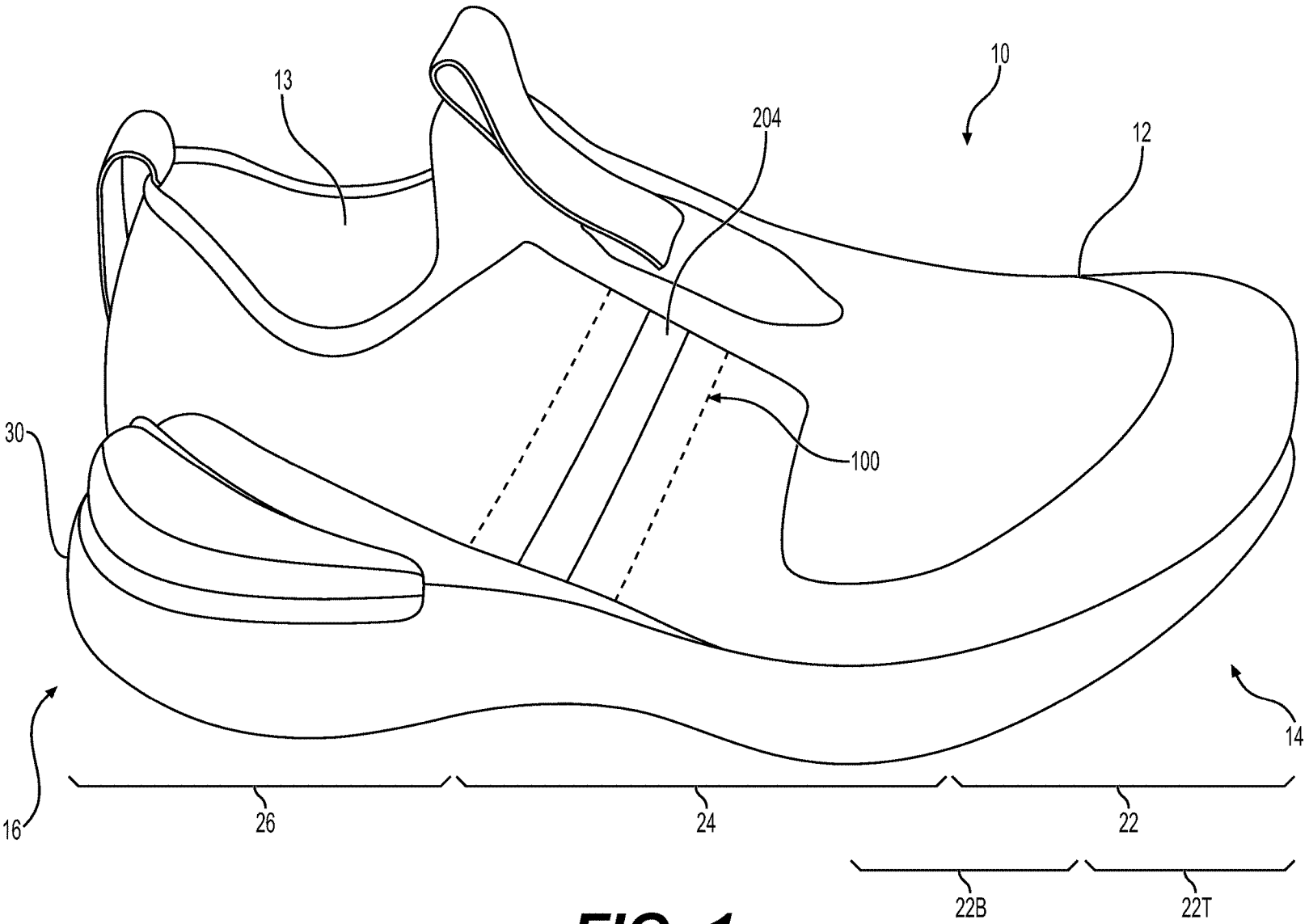
FIG. 1 is a perspective view of an article of footwear.

An article of footwear is provided that enables an adjustable fit, with a particular ability to provide lifting support to the medial midfoot, such as in the area of the navicular joint. More specifically, the article of footwear includes a sole having a medial side, a lateral side, and a foot-receiving surface. The article of footwear also includes an upper that has a medial side portion, a lateral side portion, and a support member. The medial side portion extends from the medial side of the sole and has a first distal end remote from the medial side. The lateral side portion extends from the lateral side of the sole and has a second distal end remote from the lateral side. The support member extends at least partially across the foot-receiving surface and has a first end remote from the medial side of the sole. In some embodiments, the first end of the support member is fixed to the medial side portion. In other embodiments, the first end of the support member is not fixed to the medial side portion and is thus securable to the upper separately from the medial side portion. The medial side portion and the lateral side portion are configured to wrap at least partially around a foot positioned on the foot-receiving surface and on the support member. The first distal end is then securable to the article of footwear proximal to the lateral side, and the second distal end is separately securable to the article of footwear proximal to the medial side. As used herein, "proximal" means on, about, near, by, next to, adjacent, and the like. In contrast, as used herein, "distal" means spaced apart from, away from, and the like.

For example, the medial side portion may wrap over the foot toward the lateral side, and the lateral side portion may wrap over the foot and toward the medial side. An outer surface of the support member may face an inner surface of the medial side portion.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Article of Footwear

Figure 7:
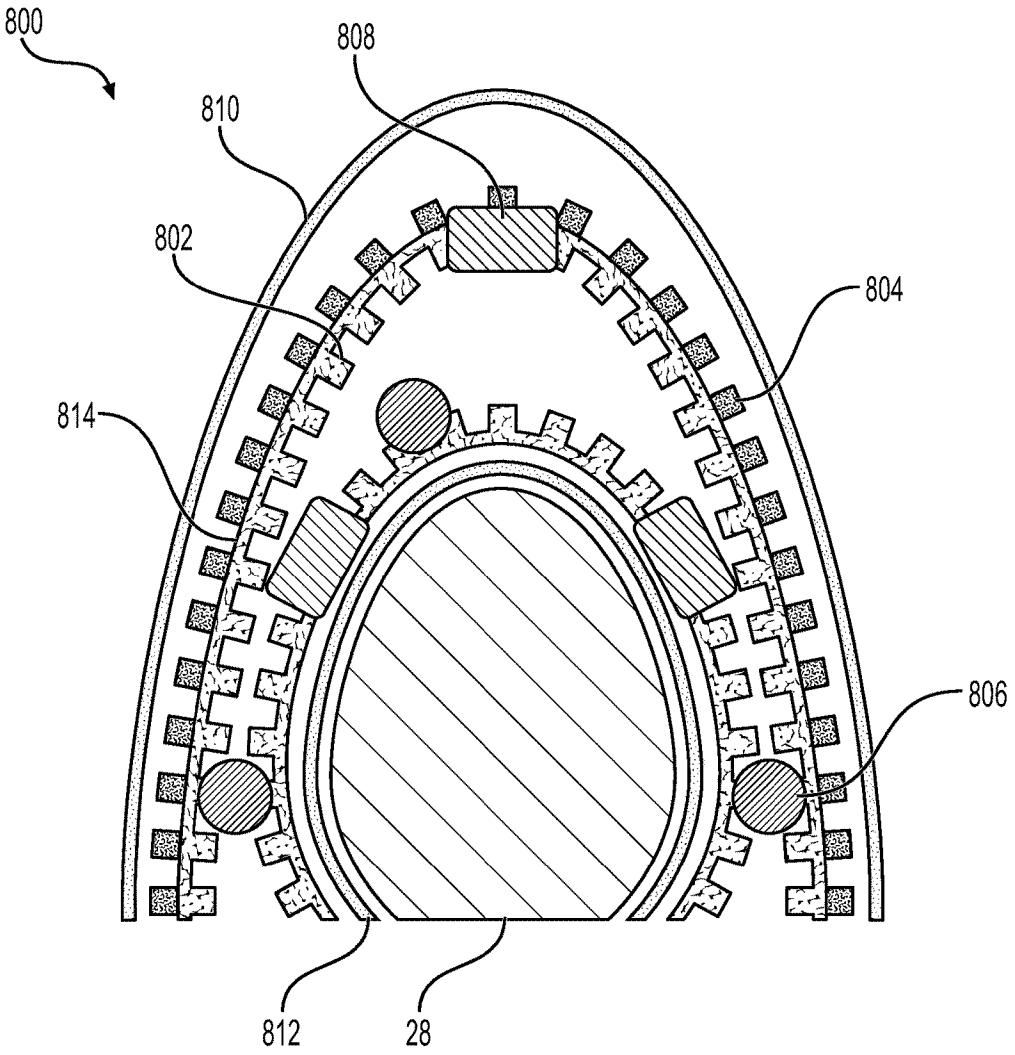
FIG. 7 is a schematic illustration of an alternative embodiment of a closure system.
Figure 8A:
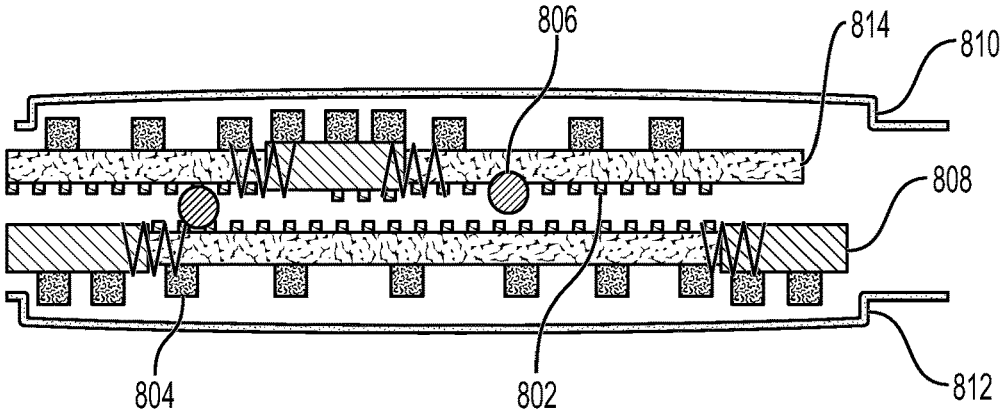
FIG. 8A is a partial schematic illustration of the closure system of FIG. 7.
Figure 8B:
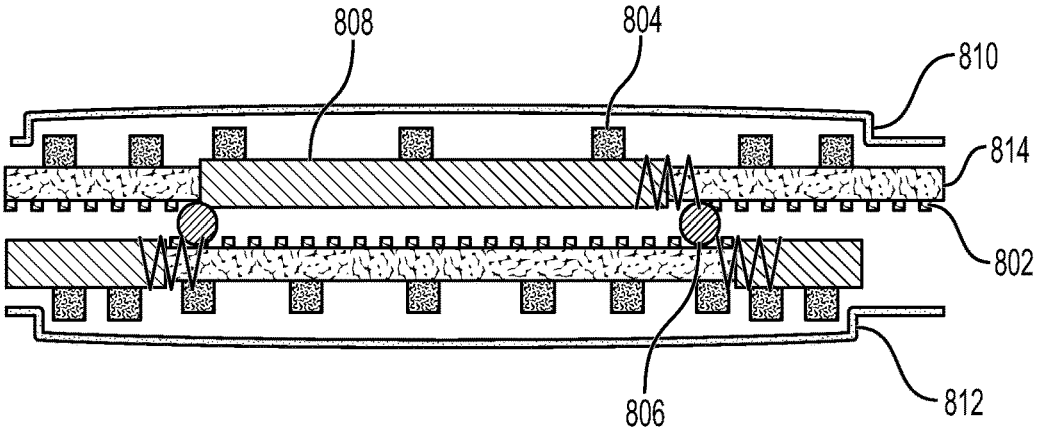
FIG. 8B is a partial schematic illustration of the closure system of FIG. 7.
Figure 8C:
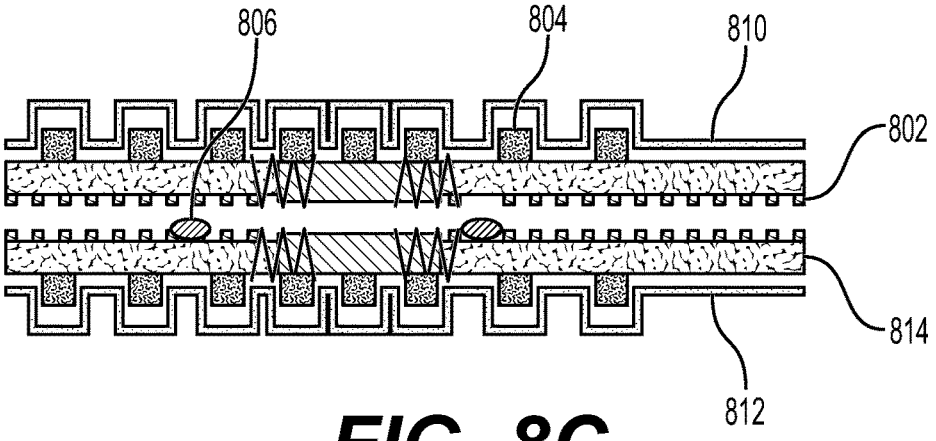
FIG. 8C is a partial schematic illustration of the closure system of FIG. 7.

Referring to FIG. 1, an article of footwear 10 may include an upper 12 that includes an opening (ankle opening) 13. The article of footwear 10 may have an anterior end 14 and a posterior end 16. The article of footwear 10 may have a medial side 18 and a lateral side 20. The article of footwear 10 may have a forefoot region 22, a midfoot region 24, and a heel region 26. The heel region 26 may generally correspond with rear portions of a human wearer's foot 28 (shown in FIGS. 2A, 2B, and 7), including the calcaneus bone, with the foot 28 corresponding to the size of the article of footwear 10. The forefoot region 22 may be subdivided into a toe portion 22T corresponding with phalanges, and a ball portion 22B associated with metatarsal bones of a foot. The midfoot region 24 may generally correspond with an arch area of the foot 28, and extends from the forefoot region 22 to the heel region 26. The article of footwear 10 may further include a sole structure 30. As shown in FIG. 1, the article of footwear 10 is for a right foot. A pair of footwear includes the article of footwear 10, and an article of footwear for a left foot that is a mirror image of the article of footwear 10.

As shown, the article of footwear 10 may be an athletic shoe, such as for track and field. The sole structure 30 may include any or all of an outsole, a midsole, and one or more fluid-filled or foam cushioning elements. The sole structure 30 may be equipped with spikes, cleats, or other ground-engaging members. In other embodiments, the article of footwear 10 could be for another category of footwear, such as a dress shoe, a work shoe, a sandal, a slipper, or a boot.

Upper

Referring to FIG. 1, the upper 12 includes interior surfaces that define an interior void configured to receive and secure the foot 28 for support on the sole structure 30. The upper 12 may be formed from one or more materials that are stitched or adhesively bonded together to form the interior void. Suitable materials of the upper 12 may include, but are not limited to, mesh, textiles, foam, leather, and synthetic leather. The materials may be selected and located to impart properties of durability, air-permeability, wear-resistance, flexibility, and comfort. The ankle opening 13 in the heel region 26 may provide access to the interior void. For example, the ankle opening 13 may receive a foot to secure the foot within the void and to facilitate entry and removal of the foot to and from the interior void.

In some examples, the upper 12 includes a strobel having a bottom surface opposing the sole structure 30 and an opposing top surface defining a footbed of the interior void. Stitching or adhesives may secure the strobel to the upper 12. The footbed may be contoured to conform to a profile of the bottom surface (e.g., plantar) of the foot. Optionally, the upper 12 may also incorporate additional layers such as an insole or sockliner that may be disposed upon the strobel and reside within the interior void of the upper 12 to receive a plantar surface of the foot to enhance the comfort of the article of footwear 10.

In some examples, the upper 12 may be formed with a closure system 100 (shown in FIGS. 2A and 2B) which may enable the upper 12 to swaddle the foot, and provide adjustable lift and support to one or more portions of the foot. In some examples, the article of footwear 10 does not include laces, straps, cords, hooks, Velcro, and other types of fasteners.

Closure System

Figure 2A:
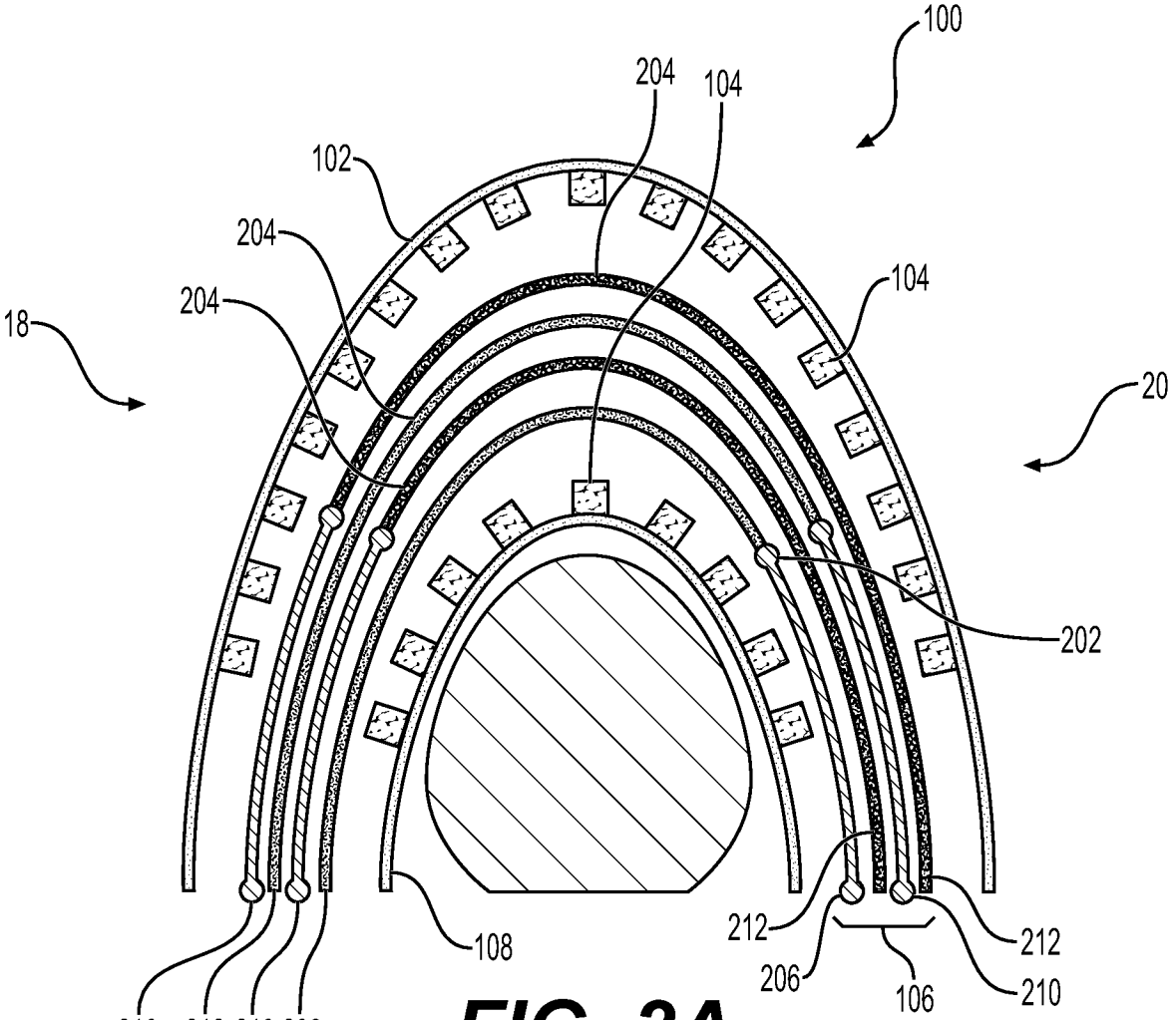
FIG. 2A is a schematic illustration of a closure system of the article of footwear of FIG. 1.
Figure 2B:
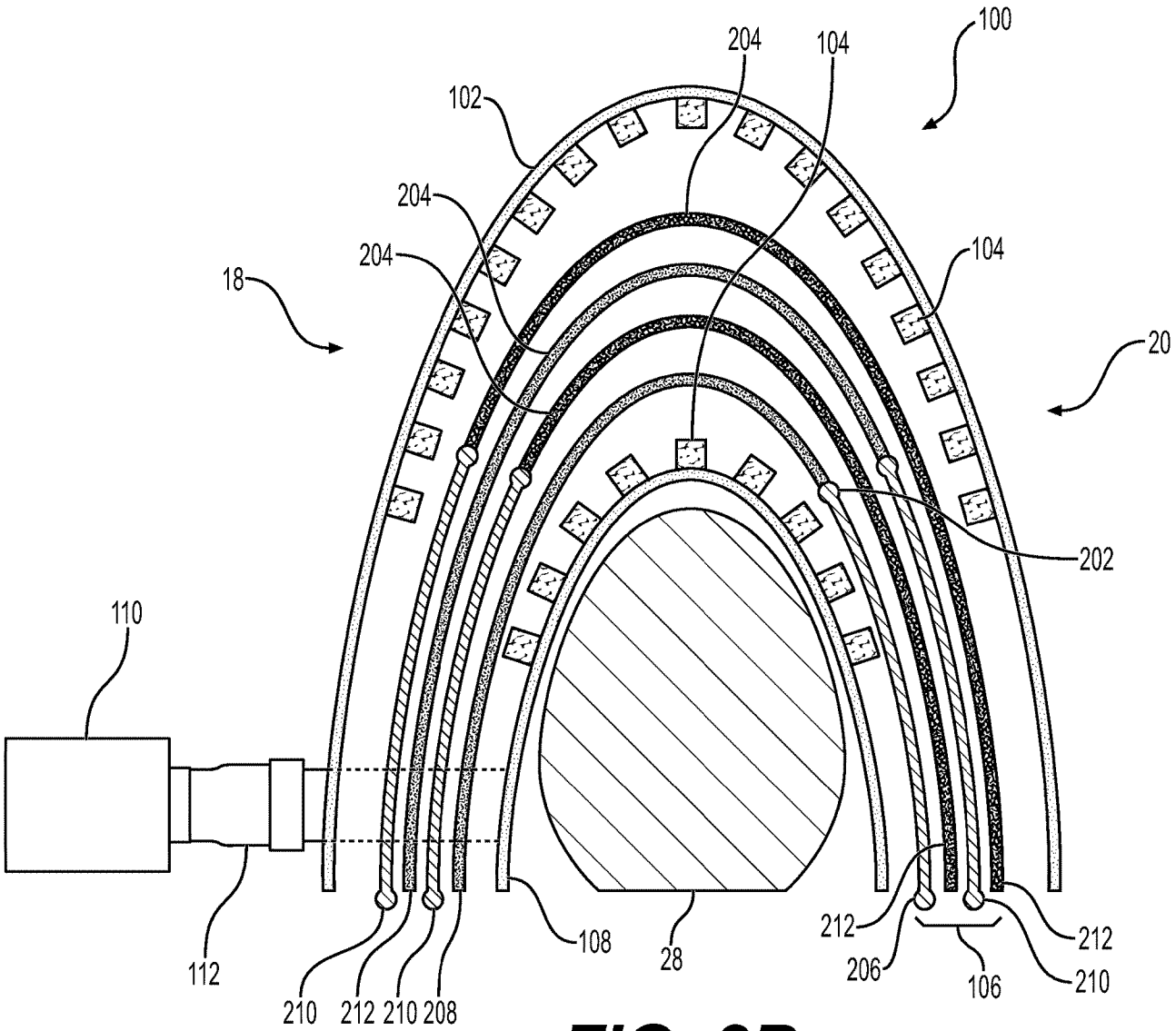
FIG. 2B is a schematic illustration of a closure system of the article of footwear of FIG. 1.
Figure 3:
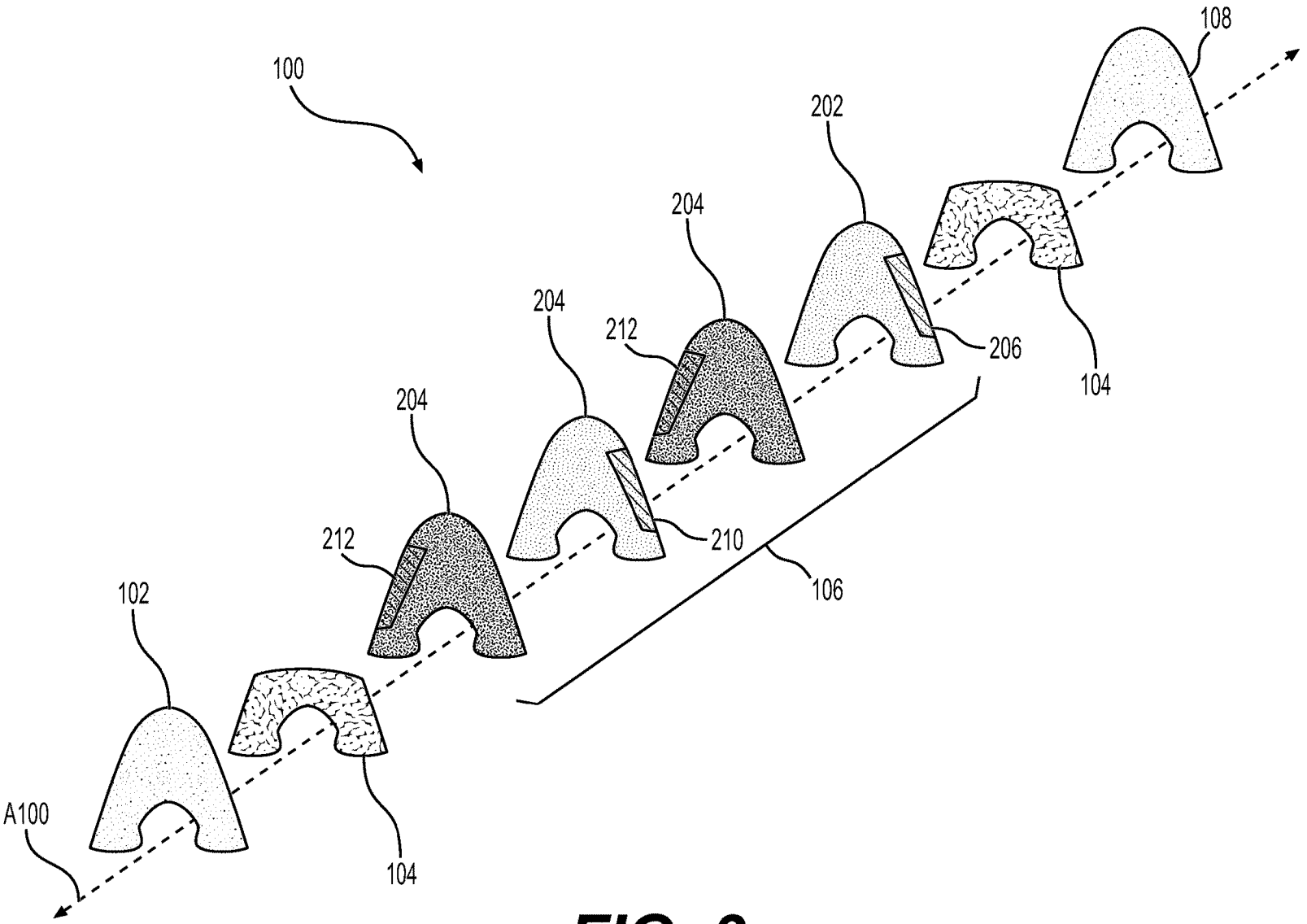
FIG. 3 is a schematic illustration of the closure system of FIG. 2B.

Referring to FIGS. 2A, 2B, and 3, the closure system 100 may include an outer film 102, one or more sets of foam components 104, a multi-sheet layer 106, an inner film 108, and a vacuum (variable pressure source) 110. The closure system 100 may extend continuously throughout a portion of the upper 12 following a path along a top surface of the foot 28 from the midfoot region 24 to the forefoot region 22. It is contemplated that the closure system 100 may also extend throughout the heel region 16 corresponding with a heel of the user.

Closure system 100 may be integrally stitched into upper 12. It is contemplated that the closure system 100 may be incorporated into upper 12 by other suitable means to allow for closure system 100 to be integrated with the upper 12. For example, closure system 100 may be hot melded to a TPU or other yarn within the upper 12. Closure system 100 may span a width of the article of footwear 10 from the medial side 18 to the lateral side 20. Closure system 100 may extend from the medial side 18 to the lateral side 20, but may not extend through the sole structure 30 to a ground-engaging surface of the article of footwear 10. In other words, the closure system 100 may be anchored to the sole structure 30 and not a ground-engaging surface of the article of footwear 10. It is contemplated that, in an alternative embodiment, the closure system 100 may extend through the sole structure 30 to a bottom of the foot of the user corresponding with the ground-engaging surface of the article of footwear 10. A distance from the outer film 102 to the inner film 108 may define a thickness of the closure system 100. The inner film 108 of the closure system 100 may be positioned against the top surface of the foot 28.

The outer film 102 and the inner film 108 may independently be transparent, translucent, and/or opaque. The outer film 102 and the inner film 108 may be, for example, a gas-impermeable film that prevents ambient air from escaping from the closure system 100. As used herein, the term "transparent" for the outer and inner films means that light passes through the film layer in substantially straight lines and a viewer may see through the film layer. In comparison, for an opaque film layer, light does not pass through the film layer and one may not see clearly through the film layer at all. A translucent film layer falls between a transparent film layer and an opaque film layer, in that light passes through a translucent layer but some of the light is scattered so that a viewer may not see clearly through the layer.

The outer film 102 and the inner film 108 may be pleated. The inner film 108 may have disposed within it a valve 112 connected to a port (not shown) of the inner film 108. It is contemplated that valve 112 may be disposed on the outer film 102 in lieu of being disposed within the inner film 108. Valve 112 may be a reverse valve capable of transferring fluid disposed between the outer film 102 and the inner film 108, to exterior of both films 102/108 and closure system 100. Valve 112 may be communicably coupled to the vacuum 110. Vacuum 110 may alter between an ON (second) and an OFF (first) state. During the OFF state, closure system 100 may generally be loose and flexible so as to allow the user of the article of footwear 10 to slide the foot 28 into the upper 12. During the ON state, the vacuum 110 may allow the closure system 100 to provide a comfort fit to the foot 28. The ON and OFF states of the vacuum 110 are described with further detail below.

Multi-sheet layer 106 may be comprised of at least one first sheet 202 and a plurality of second sheets 204 (or at least one second sheet 204 and a plurality of first sheets 202). Each of the at least one first sheets 202 may include a first area 206 and a second area 208. The first area 206 may be adjacent to the second area 208. First area 206 may include an elastic material. The elastic material, for example, may include one or more of a spandex, an elastic yarn, a silicone film, or the like. Second area 208 may include a material that is less elastic than that of first area 206. The less elastic second area 208 may include a low stretch fabric, such as, for example, a polyester fabric, a polyether fabric, a nylon fabric, paper, PET film, TPU film, or any other material capable of generating a low friction force while remaining strong in tension. In other words, first area 206 may be more elastic than second area 208. Each of the plurality of second sheets may include a first area 210 and a second area 212. A given second sheet of the plurality of second sheets 204 may have its first area 210 positioned closer to the lateral side 20 than its second area 212. The first area 210 and the second area 212 may have the same elastic properties to that of the first area 206 and the second area 208, respectively. The at least one first sheet 202 and the plurality of second sheets 204 may be interleaved. At least one first sheet 202 may be interleaved with at least two of the plurality of second sheets 204. In other words, the at least one first sheet 202 and the plurality of second sheets 204 may be stacked one on top of another in alternating fashion extending along an axis A100. Axis A100 may extend through a depth of the closure system 100 when viewed from opening 13 toward the posterior end 16. Furthermore, it is contemplated that closure system 100 may include a plurality of first sheets 202 and a plurality of second sheets 204 arranged in the same interleaved manner as set forth above. For example, the plurality of first sheets 202 and the plurality of second sheets 204 may be arranged in single alternating fashion (e.g., 202/204/202/204, etc.) However, it is also contemplated that other alternating interleaved arrangements could be used such as a double alternating pattern (202/202/204/204/202/202, etc.) or other suitable patterns. In some embodiments, there may be only a single-sheet layer.

The one or more sets of foam components 104 may include, for example, an EVA foam. In some embodiments, the one or more sets of foam components 104 may be comprised of a TPU or a silicone, which may, for example, provide a desired level of comfort and provide a layer of separation between the multi-sheet layer 106 and the inner film 108 and the outer film 102. Additionally, the one or more sets of foam components 104 may be comprised of a terry cloth fabric or the like, which may, for example, allow a desired flow of fluid (e.g. air) through and/or out of the closure system 100. Further, the separation between the multi-sheet layer 106 and the inner film 108 and the outer film 102 may allow for increased levels of sliding between the various layers of the multi-sheet layer 106. Each set of the one or more sets of foam components 104 may be disposed on a top surface of a first sheet 202 or a second sheet 204 that is closest to outer film 102. In FIGS. 2A and 2B, a second sheet 204 is shown as the sheet closest to outer film 102, but it is contemplated that a first sheet 202 may be the sheet closest to outer film 102. The top surface of sheet closes to outer film 102 may be oriented such that the one or more foam components 104 are facing the outer film 102. Additionally, a separate grouping of the one or more foam components 104 (e.g., another sheet or later of the one or more foam components) may be disposed on a bottom surface of sheet nearest the inner film 108. A first sheet 202 is shown in FIGS. 2A and 2B as the sheet closest to inner film 108, but as above, one of ordinary skill in the art will recognize that a second sheet 204 may be the sheet closest to inner film 108. The bottom surface of the sheet closest to inner film 108 may be oriented such that the one or more foam components 104 are facing the inner film 108.

Referring to FIGS. 4A-4G and 5A-5E, the outer film 102 and the inner film 108 may enclose the multi-sheet layer 106 and the one or more sets of foam components 104. The multi-sheet layer 106 may be attached at its edges to the edges of the outer film 102 and the edges of the inner film 108 via one or more of attachment portions 214. The multi-sheet layer 106, the outer film 102, the inner film 108, and the one or more attachment portions 214 may then be sealed via sealant 216. Sealant 216 may include one or more of cementing, high frequency welding, or welding. Thus, closure system 100 may be protected from the outside environment. It is contemplated that sealant 216 may be any suitable method or product of protecting the closure system 100 from the outside environment.

Figure 4A:
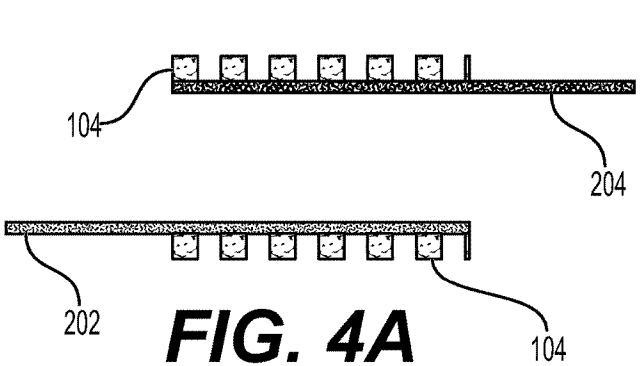
FIG. 4A is a partial schematic illustration of the closure system of FIG. 2B.
Figure 4B:
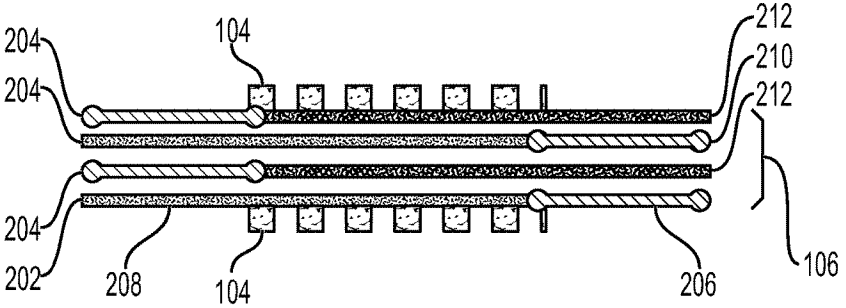
FIG. 4B is a partial schematic illustration of the closure system of FIG. 2B.
Figure 4C:
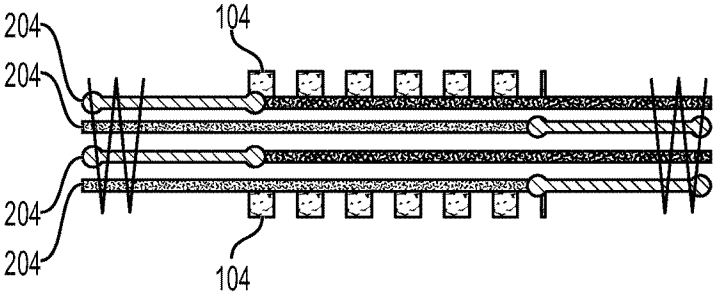
FIG. 4C is a partial schematic illustration of the closure system of FIG. 2B.
Figure 4D:
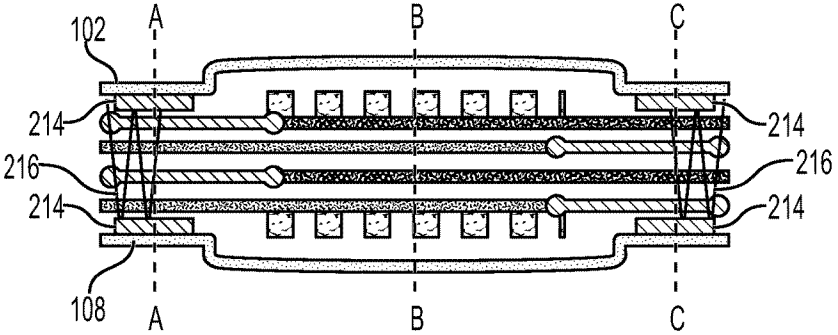
FIG. 4D is a partial schematic illustration of the closure system of FIG. 2B.
Figure 4E:
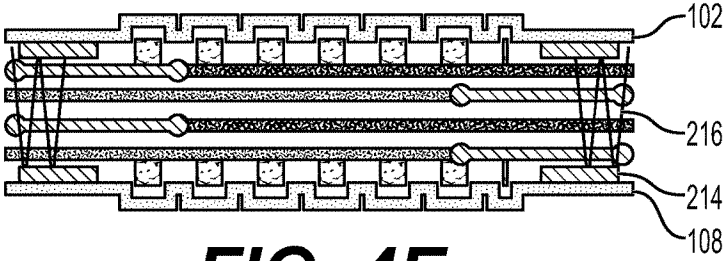
FIG. 4E is a partial schematic illustration of the closure system of FIG. 2B.
Figure 4F:
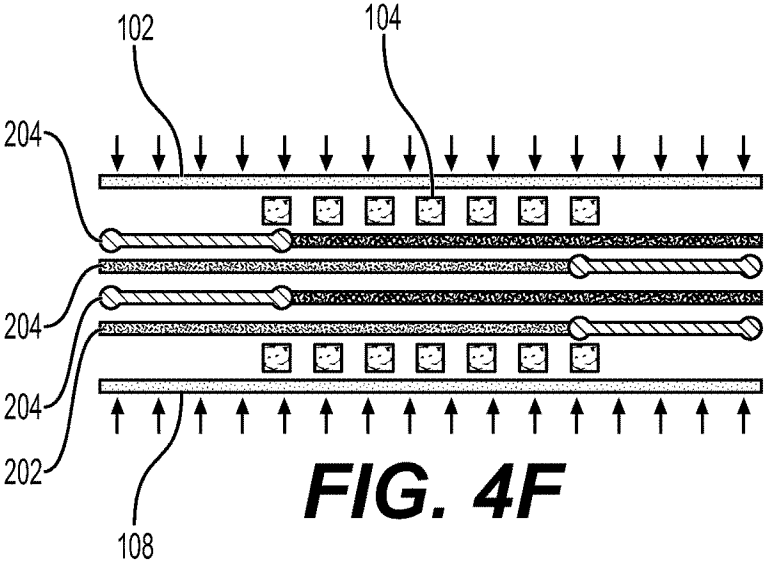
FIG. 4F is a partial schematic illustration of the closure system of FIG. 2B.
Figure 4G:
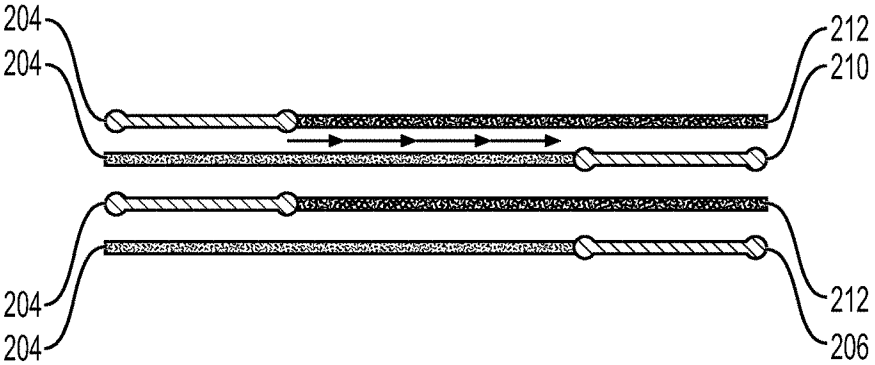
FIG. 4G is a partial schematic illustration of the closure system of FIG. 2B.
Figure 5A:
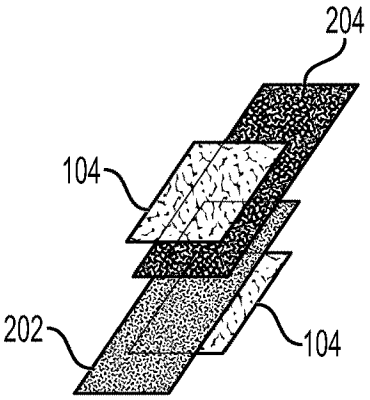
FIG. 5A is a perspective view of a portion of the closure system of FIG. 2B.
Figure 5B:
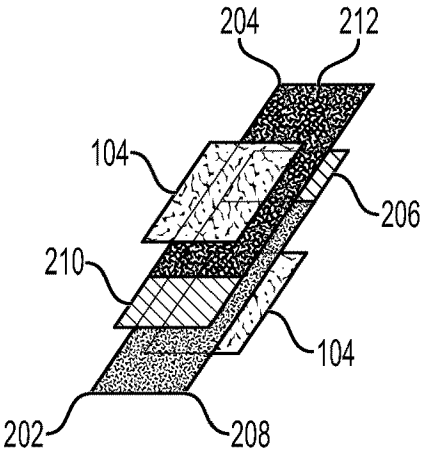
FIG. 5B is a perspective view of a portion of the closure system of FIG. 2B.
Figure 5D:
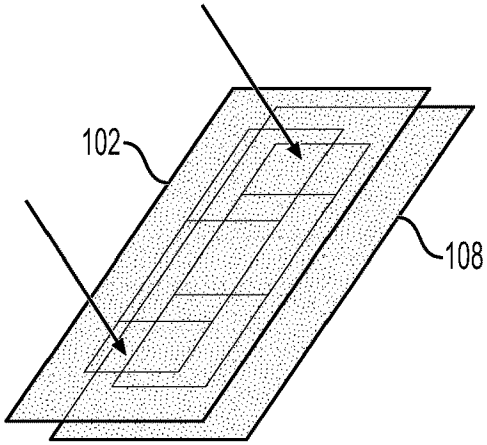
FIG. 5D is a perspective view of the closure system of FIG. 2B.
Figure 5E:
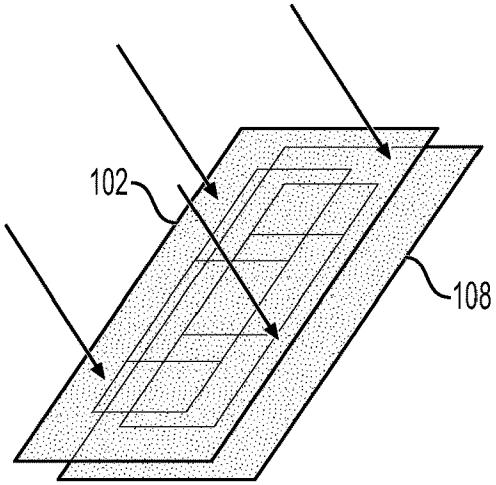
FIG. 5E is a perspective view of the closure system of FIG. 2B.
Figure 5C:
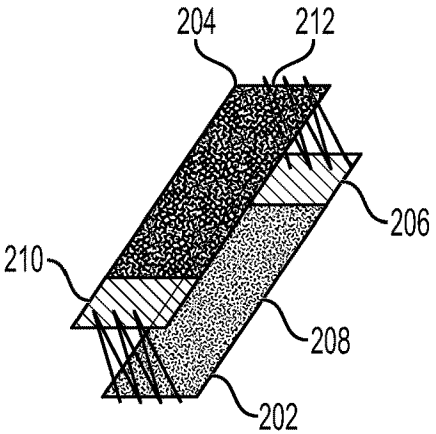
FIG. 5C is a perspective view of a portion of the closure system of FIG. 2B.

Referring to FIG. 4D, the closure system 100 may be viewed along a path A-A, wherein when viewing along the path A-A from the top down, the path may encounter the outer film 102, one of the one or more attachment portions 214, the first area 210 of a first sheet of the plurality of second sheets 204, the second area 212 of a second sheet of the plurality of second sheets 204, the first area 210 of a third sheet of the plurality of second sheets 204, the second area 208 of the at least one first sheet 202, one of the one or more attachment portions 214, the inner film 108, and sealant 216 connected between each of the previous elements. When viewing closure system 100 top down along path B-B, the path may encounter the outer film 102, a first set of the one or more sets of foam components 104 disposed on the second area 212 of the first sheet of the plurality of second sheets 204, the second area 212 of the second of the plurality of second sheets 204, the second area 212 of the third sheet of the plurality of second sheets 204, the second area 208 of the at least one first sheet 202, a second set of the one or more sets of foam components 104 and the inner film 108. Following the path C-C, when viewing the path from the top down, the path may encounter the outer film 102, one of the one or more attachment portions 214, the second area 212 of a first sheet of the plurality of second sheets 204, the first area 210 of a second sheet of the plurality of second sheets 204, the second area 212 of a third sheet of the plurality of second sheets 204, the first area 206 of the at least one first sheet 202, one of the one or more attachment portions 214, the inner film 108, and sealant 216 connected between each of the previous elements.

In other words, the closure system 100 may have a stacked arrangement corresponding to the desired interleaved pattern. The desired interleaved pattern may affect what is encountered when following along any of paths A-A, B-B, or C-C. For example, it is contemplated that the sheet closest to outer film 102, i.e. the first sheet of the plurality of second sheets 204, may be either an at least one first sheet 202 or one of the plurality of second sheets 204. Additionally, in some cases, only the second area of such sheets and not the first area of such sheets may be the area closest to the outer film 102 of the inner film 108.

In some embodiments, the attachments between portions of the closure system 100 may be stitched, cemented, hot melted, high-frequency welded, or attached by any other suitable method. Additionally or alternatively, it is contemplated that any combination of stitching, cementing, hot melting, and/or high-frequency welding may be used in attaching the layers and/or the films of the closure system 100. For example, the second area 208 may be stitched to the plurality of second sheets 204 while the outer film 102 and the inner film 108 may be cemented to attachment portions 214 while attachments portions 214 are stitched to the multi-sheet layer 106.

Configuration Changes

The closure system 100 may be configured to transition between at least two different configurations as set forth above. In an exemplary embodiment, the closure system 100 may operate in a first configuration and a second configuration. The first configuration may correspond to the closure system 100 being in a relaxed state. During the first configuration, the article of footwear 10 may be configured for receiving or removing the foot 28 of the user, and the vacuum 110 may not be engaged (is off). In other words, the multi-sheet layer 106 may remain loose while in the first configuration and there may be few friction forces present between the interleaved layers thereby allowing for the insertion and the removal of the foot 28 of the user.

In the first configuration, the closure system 100 may be stretched by the user of the article of footwear 10 pulling the closure system 100 toward the user via the opening 13 and inserting the foot 28 of the user through the ankle opening 13. In other words, the user of the article of footwear 10 may pull the closure system 100 toward the user and the multi-directional movement of the multi-sheet layer 106 may allow for the closure system 100 to stretch in the direction corresponding to the user's pulling to accommodate and removal and insertion of foot 28. During the first configuration, the outer film 102 and the inner film 108 may be compressed and the pleats of the outer film 102 and the inner film 108 may be straightened. The at least one first sheet 202 and the plurality of second sheets 204 may be engaged such that the at least one first sheet 202 slides in multiple directions outwardly upon insertion of the foot 28 and the plurality of second sheets 204 may stretch vertically upon insertion of the foot 28. The interleaved layers of the multi-sheet layer 106 may be pulled in opposing directions to generate a first locking force for the closure system 100. In other words, the multi-sheet layer 106 may be stretched in directions corresponding to a user opening the article of footwear 10 so as to allow insertion of the foot 28. Upon insertion of the foot 28, the first locking force generated by the closure system 100 for the upper 12 may allow the upper 12 to loosely fit to the foot 28. In other words, the tension applied to the foot 28 may increase slightly, but still allow for quick insertion or removal of the foot 28.

The second configuration may correspond with the operation of the vacuum 110 (i.e., when the vacuum 110 is in the "ON" state). During the second configuration, the vacuum 110 may engage with the closure system 100 to provide suction on the foot 28 relative to the interior of the closure system 100. The pleats of the outer film 102 and the inner film 108 may be flattened during the second configuration. In other words, the flattening of the pleats corresponds to the outer film 102 and the inner film 108 being drawn toward the interior of closure system 100 via the operation of the vacuum 110. Further, the operation of the vacuum 110 may generate a second locking force, wherein the second locking force is greater than the first locking force. The second locking force corresponds to a further increase in the tensioning of the closure system 100 due to the engagement of the vacuum 110. Further, the second locking force may enable the closure system 100 to fit to the corresponding size of the foot 28 and the friction between each layer of the multi-sheet layer 106 may be at its greatest. In other words, when the vacuum 110 is engaged, the interleaved layers of the multi-sheet layer 106 may be further pulled in opposing directions so as to create a larger locking force by way of the friction of the interleaved layers which provides a snug and comfortable fit against the foot 28.

In use, the upper 12 may move between the first and the second configurations by adjusting a fluid pressure within the closure system 100. In exemplary embodiments, the pressure within the closure system 100 may be reduced by drawing a vacuum within the closure system 100 through the port of the inner film 108 communicably coupled to the valve 112. The vacuum may be drawn using the vacuum 110 or provided as a peripheral (i.e. independent) accessory to the article of footwear 10. As the pressure is reduced (e.g. below ambient) within the closure system 100, the interleaved multi-sheet layers 106 collapse and the upper 12 constricts the foot 28. Conversely, the pressure within the closure system 100 may be increased and the multi-leaved sheet layers 106 may relax allowing the closure system 100 to transition to a more relaxed state corresponding to the second configuration.

Alternative Embodiments

Figure 6:
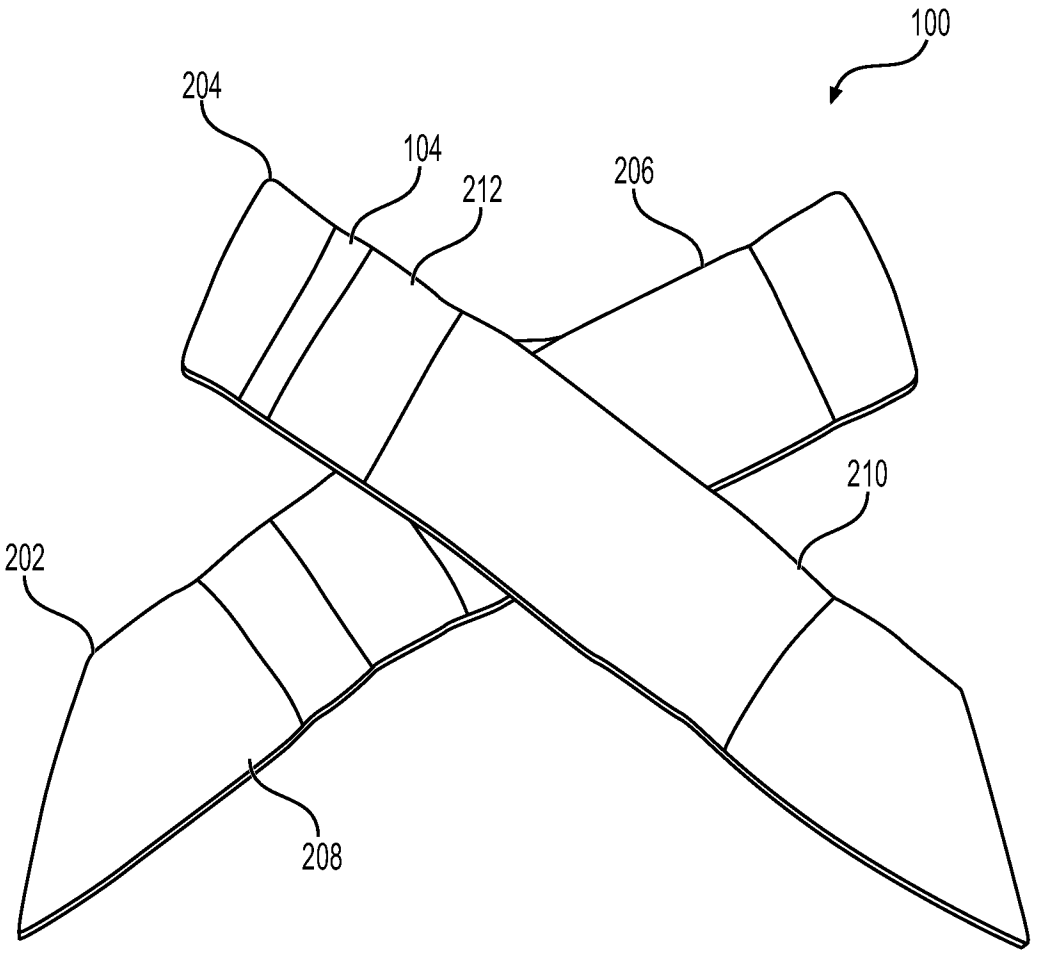
FIG. 6 is top-down view of an embodiment of the closure system of FIG. 2B.

In an alternative embodiment shown in FIG. 6 of the closure system 100, and more specifically of the multi-sheet layer 106, may have a shape that is substantially X-shaped when incorporated in upper 12. For example, the interleaved sheets of multi-sheet layer 106 may sit one on top of another in alternating fashion in a diagonal crossing pattern. It is contemplated that the closure system 100 may have a shape that is diamond, straight, star, or any other shape capable of stretching along an upper 12 to provide a snug and comfortable fit.

In an alternative embodiment shown in FIGS. 7 and 8A-8C, the closure system 800 may include a plurality of microlocks 802, a plurality of stiff foam elements 804, a plurality of soft foam elements 806, one or more flexible bands 808, an outer film 810, an inner film 812, one or more gripping mats 814, at least one valve (not shown), and a vacuum (not shown). The one or more gripping mats 814 may have disposed on it the plurality of microlocks 802. The one or more gripping mats 814 having the plurality of microlocks 802 disposed thereon may be attached to one of the one or more flexible bands 808. The plurality of stiff foam elements 804 may be disposed on a top surface of one of the one or more flexible bands 808 and one or more gripping mats 814, wherein the plurality of stiff foam elements 804 face an outer film 810.

The closure system 800 may engage in at least two different configurations. The closure system 800 may operate in a first configuration and a second configuration. The first configuration may correspond to the closure system 800 being in a relaxed state. During the first configuration, the article of footwear 10 may be free of the foot 28 and the vacuum may not be engaged. The various components of the closure system 800 may remain in their relaxed and resting state during the first configuration. Further, in the first configuration, the plurality of microlocks 802 may remain apart so as not to be interlocking. In the first configuration, the user's foot 28 may be inserted into the article of footwear 10 such that the one or more flexible bands 808 is stretched. Further, in the first configuration, the microlocks 802 may engage the plurality of soft foam elements 806 as well as the opposing microlocks 802. In the second configuration, the vacuum may be engaged such that the outer film 810 and the inner film 812 are compressed to engage the opposing microlocks 802 as well as the plurality of soft foam elements 806, thus creating a locking force.

Figure 9:
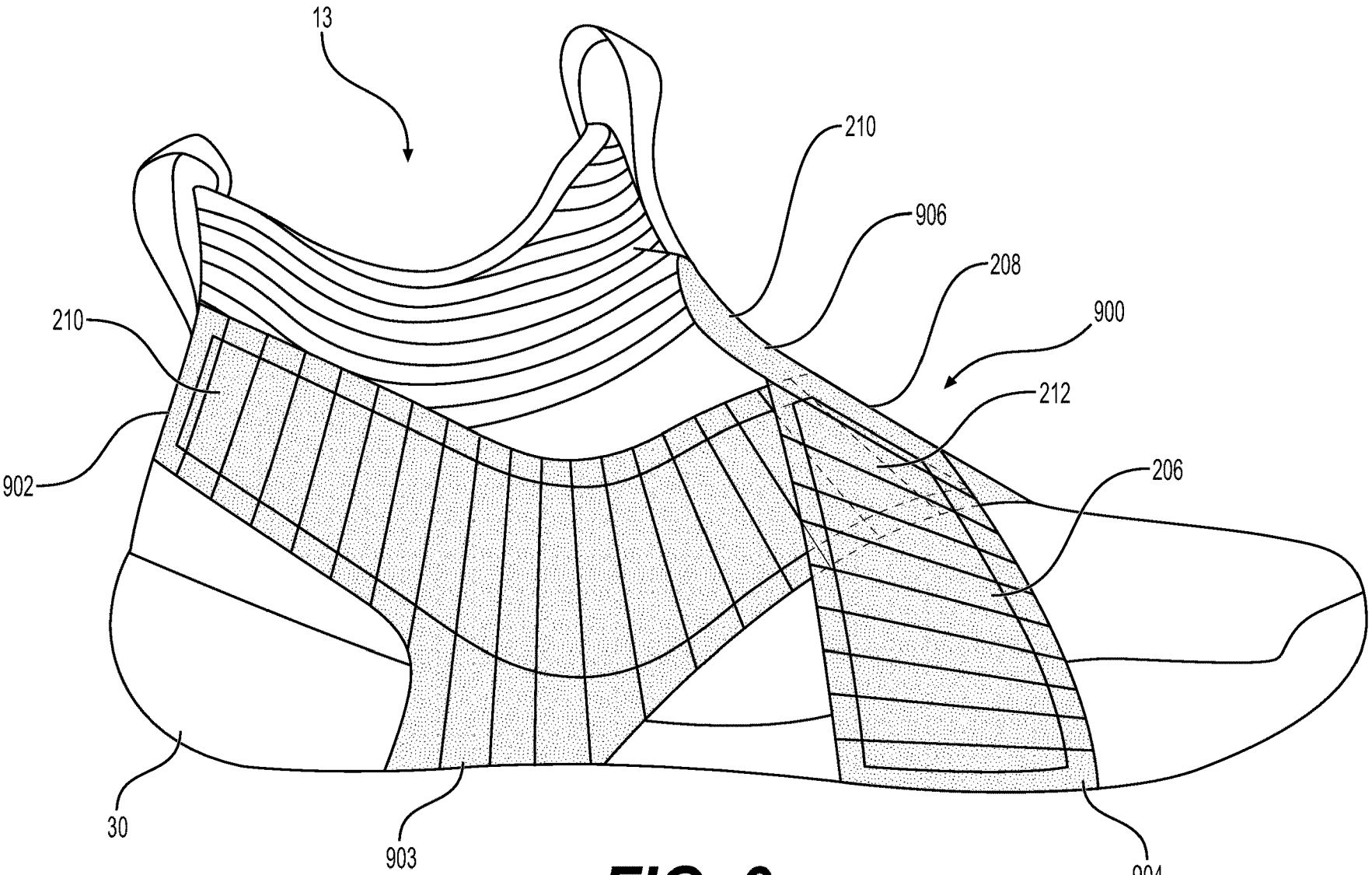
FIG. 9 is a perspective view of an alternative embodiment of a closure system.

Referring to FIG. 9, in an alternative embodiment of the closure system 100, a first portion 902 of a closure system 900 may extend from the heel region 16 to the mid-foot region 14, wherein the first portion 902 of the closure system 900 is disposed beneath the opening 13 and above the sole structure 30. In other words, the first portion 902 may leave a gap between the first portion and the sole structure 30 and a gap between the ankle opening 13 the first portion 902. Additionally, the first portion 902 may include a securing portion 903, the first area 210, and the second area 212. The securing portion 903 may extend from the first portion 902 toward the sole structure 30. The first area 210 may extend from the heel region 16 to the mid-foot region 14. The second area 212 may be present on the top surface of the user's foot in the mid-foot region 14. A second portion 904 of the closure system 900 may span the upper 12 from the medial side 18 to the lateral side 18 in the mid-foot region 14. The second portion 904 may include the first area 206 and the second area 208. The first area 206 may extend from the lateral side 18 toward the top surface of the user's foot in the mid-foot region 14. The second area 208 may be disposed on the top surface of the user's foot in the mid-foot region 14. Additionally, a third portion 906 of the closure system 900 may extend from the second portion 904 of the closure system 900 toward the opening 13. The third portion 906 may include the first area 210 and the second area 212. The first area 210 may extend from below the ankle opening 13 toward the area corresponding to the top surface of the user's foot in the mid-foot region 14. Second area 212 may be disposed on the area corresponding to the top surface of the user's foot in the mid-foot region 14. The first portion 902 of the closure system 900, the second portion 904 of the closure system 900, and the third portion 906 of the closure system 900 may overlap one another on the top surface of the user's foot in the mid-foot region 14, and each of the second areas 208 and 212 may overlap one another for each respective portion 902, 904, and 906.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The following clauses provide an exemplary configuration for an article of footwear and sole structure described above.

Clause 1. An article of footwear, the article comprising: a sole structure; and an upper coupled to a top of the sole structure, the upper including an opening and a closure system, wherein the closure system includes: at least one first sheet, a plurality of second sheets, wherein the at least one first sheet and the plurality of second sheets are interleaved.

Clause 2. The article of footwear of clause 1, wherein at least one of the plurality of first sheets is interleaved with two second sheets, and at least one of the plurality of second sheets is interleaved with two first sheets.

Clause 3. The article of footwear of clause 1, wherein the plurality of first sheets and the plurality of second sheets alternate with one another along an axis extending through a depth of the closure system.

Clause 4. The article of footwear of clause 1, wherein each of the plurality of first sheets includes a first area and a second area adjacent to the first area, wherein the first area is more elastic than the second area.

Clause 5. The article of footwear of clause 4, wherein the first area includes one or more of spandex, elastic yarn, or silicone film.

Clause 6. The article of footwear of clause 4, wherein the second area includes paper, polyester fabric, PET film, TPU film, polyether fabric.

Clause 7. The article of footwear of clause 1, wherein each of the plurality of first sheets includes a first area and a second area adjacent to the first area, wherein the first area is pleated.

Clause 8. The article of footwear of clause 4, wherein the first area of the plurality of first sheets is positioned medial relative to the second area of the plurality of first sheets.

Clause 9. The article of footwear of clause 8, wherein each of the second sheets includes a first area and a second area, wherein for a given second sheet, the first area is positioned closer to a lateral side of the article of footwear than the second area.

Clause 10. The article of footwear of clause 1, wherein the article of footwear does not include any laces, Velcro, straps, or fasteners.

Clause 11. The article of footwear of clause 1, wherein the closure system includes an outer film and an inner film, wherein the plurality of first sheets and the plurality of second sheets are enclosed by the outer film and the inner film.

Clause 12. The article of footwear of clause 11, wherein the closure system further includes a valve configured to remove a fluid from the closure system.

Clause 13. The article of footwear of clause 12, wherein the valve is disposed on the inner film.

Clause 14. The article of footwear of clause 13, wherein the closure system further includes a pressure source configured to withdraw the fluid from the closure system, wherein the closure system is configured to transition between a first configuration, a second configuration, and a third configuration, wherein in the first configuration, the pressure source is inactive, in the second configuration, a foot is inserted and the closure system is stretched, and in the third configuration, the pressure source is active and a partial vacuum is applied to the closure system.

Clause 15. The article of footwear of clause 14, wherein, in the second configuration, the outer film and the inner film are stretched vertically, the plurality of first sheets are stretched horizontally outward in relation to a central longitudinal axis, and the plurality of second sheets are stretched vertically in relation to the central longitudinal axis.

Clause 16. The article of footwear of clause 14, wherein in the third configuration, the at least one first and the plurality of second sheets are pulled taught to the foot.

Clause 17. An article of footwear, the article comprising: a sole structure;

and an upper coupled to a top of the sole structure, the upper including an opening, and a closure system, wherein the closure system includes: at least one first sheet, a plurality of second sheets, wherein the at least one first sheet and the plurality of second sheets are interleaved, an outer film and an inner film enclosing the at least one first sheet and the plurality of second sheets; a valve, and a pressure source.

Clause 18. The article of footwear of clause 17, wherein the pressure source is configured to withdraw a fluid from the closure system, and wherein the pressure source is communicably coupled to the inner film.

Clause 19. The article of footwear of clause 17, wherein the article of footwear does not include any of: a strap, a fastener, a lace, or Velcro.

Clause 20. An article of footwear, the article comprising: a sole structure;

and an upper coupled to a top of the sole structure, the upper including an opening, and a closure system, wherein the closure system includes: at least one first sheet, a plurality of second sheets, wherein the at least one first sheet and the plurality of second sheets are interleaved, wherein each of the plurality of first sheets includes a first area and a second area adjacent to the first area, wherein the first area is more elastic than the second area, and wherein each of the second sheets includes a first area and a second area, wherein for a given second sheet, the first area is positioned closer to a lateral side of the article of footwear than the second area, and an outer film and an inner film enclosing the at least one first sheet and the plurality of second sheets.

I claim:

1. An article of footwear, the article comprising:

a sole structure; and an upper coupled to a top of the sole structure, the upper including an opening and a closure system, wherein the closure system comprises:

a multi-sheet layer having at least one first sheet, and a plurality of second sheets, wherein the at least one first sheet and the plurality of second sheets are interleaved, an inner film and an outer film wherein the at least one first sheet and the plurality of second sheets are enclosed by the outer film and the inner film, and one or more sets of foam components located on a top surface of one or more of the at least one first sheet or the plurality of second sheets and configured to provide a layer of separation between the multi-sheet layer and the inner film and outer film.

2. The article of footwear of claim 1, wherein the at least one of the first sheet is interleaved with two of the plurality of second sheets, and at least one of the plurality of second sheets is interleaved with two first sheets.

3. The article of footwear of claim 1, wherein the at least one first sheet and the plurality of second sheets alternate with one another along an axis extending through a depth of the closure system.

4. The article of footwear of claim 1, wherein the at least one each first sheet includes a first area and a second area adjacent to the first area, wherein the first area is more elastic than the second area.

5. The article of footwear of claim 4, wherein the first area includes one or more of spandex, elastic yarn, or silicone film.

6. The article of footwear of claim 4, wherein the second area includes paper, polyester fabric, PET film, TPU film, polyether fabric.

7. The article of footwear of claim 1, wherein each of the at least one first sheet includes a first area and a second area adjacent to the first area, wherein the first area is pleated.

8. The article of footwear of claim 4, wherein the first area of the at least one first sheet is positioned medial relative to the second area of the at least one of first sheet.

9. The article of footwear of claim 8, wherein each of the plurality of second sheets includes a first area and a second area, wherein for a given second sheet, the first area is positioned closer to a lateral side of the article of footwear than the second area.

10. The article of footwear of claim 1, wherein the article of footwear does not include any laces, hook and loop fasteners, straps, or fasteners.

11. The article of footwear of claim 1, wherein the one or more sets of foam components is comprised of one or more of an EVA foam, a TPU, or a silicone.

12. The article of footwear of claim 1, wherein the closure system further comprises includes a valve connected to a port on one of the inner film or outer film.

13. The article of footwear of claim 12, wherein the valve is configured to transfer air disposed between the outer film and the inner film.

14. The article of footwear of claim 13, wherein the closure system further includes a pressure source configured to withdraw the air from the closure system by providing suction on a foot relative to an interior of the closure system.

15. The article of footwear of claim 14, wherein, the closure system is configured to transition among a first configuration, a second configuration, and a third configuration, wherein in the first configuration, the pressure source is inactive, in the second configuration, a foot is inserted and the outer film and the inner film are stretched vertically, the at least one first sheet is stretched horizontally outward in relation to a central longitudinal axis, and the plurality of second sheets are stretched vertically in relation to the central longitudinal axis, and wherein in the third configuration, the pressure source is active and a partial vacuum is applied to the closure system.

16. The article of footwear of claim 15, wherein in the third configuration, the at least one first sheet and the plurality of second sheets are pulled taught to the foot.

17. An article of footwear, the article comprising:

a sole structure; and an upper coupled to a top of the sole structure, the upper including an opening, and a closure system, wherein the closure system includes:

at least one first sheet, a plurality of second sheets, wherein the at least one first sheet and the plurality of second sheets are interleaved, an outer film and an inner film comprising one or more pleats, the outer film and the inner film enclosing the at least one first sheet and the plurality of second sheets;

a valve, and a pressure source removably coupled to the valve, wherein the closure system is configured to transition between a first configuration a second configuration, and wherein in the first configuration the outer film and the inner film are compressed, the one or more pleats of the outer film and inner film are straightened, and the at least one first sheet slides in multiple directions outwardly and the plurality of second sheets stretch vertically upon insertion of a foot into the article of footwear.

18. The article of footwear of claim 17, wherein the article of footwear does not include any of: a strap, a fastener, a lace, or a hook and loop fastener.

19. An article of footwear, the article comprising:

a sole structure; and an upper coupled to a top of the sole structure, the upper including an opening, and a closure system, wherein the closure system includes a multi-sheet layer comprising:

at least one first sheet, a plurality of second sheets, wherein the at least one first sheet and the plurality of second sheets are interleaved, wherein the at least one each of the plurality of first sheet includes a first area and a second area adjacent to the first area, wherein the first area is more elastic than the second area, and wherein each of the plurality of second sheets includes a first area and a second area, wherein for a given second sheet, the first area is positioned closer to a lateral side of the article of footwear than the second area, an outer film and an inner film enclosing the at least one first sheet and the plurality of second sheets; and one or more sets of foam components located on a top surface of one or more of the at least one first sheet or the plurality of second sheets and configured to provide a layer of separation between the multi-sheet layer and the inner film and outer film.

* * * * *